US005281078A

United States Patent [19]

Mills, Jr.

[11] Patent Number: 5,281,078

[45] Date of Patent: Jan. 25, 1994

[54] PORTABLE HOIST

[76] Inventor: Roy D. Mills, Jr., 55 Brookwood Ave. N.W., Concord, N.C.

[21] Appl. No.: 960,516

[22] Filed: Oct. 13, 1992

[51] Int. Cl.[5] ..... B66C 23/04

[52] U.S. Cl. ..... 414/680; 212/180; 212/264; 414/563

[58] Field of Search ..... 414/539, 540, 546, 547, 414/555, 563, 680, 728, 729; 280/402; 212/180, 260, 261, 264

[56] References Cited

U.S. PATENT DOCUMENTS

| | | | |
|---|---|---|---|
| 2,550,185 | 4/1951 | Busch | 414/546 X |
| 3,059,785 | 10/1962 | Buckeye | 414/728 |
| 3,329,291 | 7/1967 | Przybylski et al. | 414/718 |
| 3,700,125 | 10/1972 | Aquila | 280/402 X |
| 3,767,069 | 10/1973 | White, Jr. et al. | 414/563 |
| 3,878,948 | 4/1975 | Corompt | 414/546 |
| 3,912,088 | 10/1975 | Bronfman | 212/260 X |
| 3,942,664 | 3/1976 | Lemaire | 414/546 X |
| 4,013,184 | 5/1977 | Lacy | 414/546 X |
| 4,063,374 | 12/1977 | Washington | 414/728 X |
| 4,069,922 | 1/1978 | Hawkins | 212/181 |
| 4,090,624 | 5/1978 | Krein et al. | 414/546 |
| 4,509,894 | 4/1985 | Rolfe | 414/555 |
| 4,556,358 | 12/1985 | Harlan | 414/546 X |
| 4,838,753 | 6/1989 | Gehman et al. | 414/563 |
| 4,861,221 | 8/1989 | Krisa | 414/563 |
| 5,014,863 | 5/1991 | Vlaanderen | 414/546 X |
| 5,064,078 | 11/1991 | Van Staveren | 414/563 X |
| 5,108,247 | 4/1992 | Vlaanderen | 414/546 X |
| 5,163,803 | 11/1992 | Marola | 414/563 |

OTHER PUBLICATIONS

*Beef Today;* Aug. 1992; p. 21.

*Primary Examiner*—David A. Bucci

*Attorney, Agent, or Firm*—Bell, Seltzer, Park & Gibson

[57] ABSTRACT

A portable hoist adapted for attachment to a ball hitch mounted in a central location in a flat bed of a truck is disclosed. The hoist comprises an elongate base frame member, a receptacle mounted at the front end of the base frame member and adapted for releasable attachment to the ball hitch, an upright frame member, and a boom having load engaging device mounted to the upright member. The upright member and the base frame member are pivotally interconnecting so as to permit pivotal movement of the upright frame member about a horizontal axis extending laterally across the bed of the truck. A load is lifting via the operation of lifting device interconnected between the base frame member and one of the upright frame member and the boom.

11 Claims, 4 Drawing Sheets

PORTABLE HOIST

FIELD OF THE INVENTION

The present invention relates generally to portable hoists attachable to a vehicle for lifting and moving a load. More specifically, the invention relates portable hoists which are easily assembled and attached to a ball hitch mounted in a flat bed of a vehicle such as a pick-up truck.

BACKGROUND OF THE INVENTION

Vehicle mounted hoists or cranes have become increasingly popular in recent years. Typically the hoist or crane is mounted on the bed of a vehicle such as a pickup truck, and are used for loading and unloading the truck. For example, U.S. Pat. No. 4,069,922 to Hawkins discloses a portable crane including an apparatus for supporting a hoist mounted on the frame of a pickup truck. The apparatus includes a upright structure carrying an outwardly extending boom and an auxiliary or supplemental support leg provided outside of the vehicle to support this hoist mechanism and prevent excessive unbalanced loading on the wheel structure of the vehicle.

U.S. Pat. No. 4,556,358 to Harlan also discloses a hoist for lifting loads into a vehicle such as a truck. The portable hoist includes a fixed mounting that is attached to a support, i.e., the sidewall of a truck. An upright support structure is connected to the mounting by a vertical hinge assembly so that the support structure can swing about a vertical axis. A boom is pivotally secured to the support structure so that the free end of the boom can be raised or lowered.

Although these and other structures can provide good lifting capability using a vehicle such as a truck, typically, these devices are cumbersome to use, requiring permanent mountings, complex assembly and limited range of maneuverability. Accordingly there exists a need for a device that is easily assembled and disassembled and mounted to a conventional vehicle such as a pickup truck, and still provide a sufficient range of movement and load capacity.

SUMMARY OF THE INVENTION

The present invention provides a portable hoist that can be easily assembled and attached to a vehicle such as a pick-up truck. Specifically, the hoist is adapted for attachment to a ball hitch mounted at a central location in a flat bed of a truck. Such hitches are well known and are widely used, for example, by farmers to create a strong, heavy load bearing hitch for transporting trailers, farm equipment, and the like with the truck. Because the portable hoist of the present invention is adapted for attachment to a readily available hitch, no permanent or complicated mountings are required. This in turn provides an easily assembled and attachable means for lifting and transporting loads. In addition, such ball hitches are typically adapted to transport heavy loads, and thus the hoist of the invention can have desirable load capacity.

The hoist of the present invention comprises an elongate base frame member having front and rear opposite ends. A receptacle, which is adapted for releasable attachment to the ball hitch, is mounted at the front end of the base frame member so that the base frame member may be positioned to extend longitudinally along the bed of the truck with the rear end thereof resting upon the rear edge portion of the truck bed. The hoist further includes an upright frame member having an upper end and a lower end, with a boom mounted to the upper end thereof so as to be substantially parallel to and aligned with the base frame member when viewed in plan. The boom has a free end which extends longitudinally beyond the rear end of the base frame member and which is adapted for attachment to load engaging means.

The upright frame member is pivotally movable about a horizontal axis extending laterally across the bed of the truck. The pivotal movement is provided by means pivotally interconnecting the lower end of the upright member to the rear end of the base frame member. The portable hoist is operated to lift a load attached to load engaging means via lifting means interconnected between the base frame member and either the upright frame member or the boom. The lifting means is operated to selectively pivot the upright frame member and boom about the horizontal axis. Because the upright frame member is pivotally movable about the horizontal axis described above, and further because lifting means may be variably positioned, the portable hoist of the present invention provides a wide range of movement.

BRIEF DESCRIPTION OF THE DRAWINGS

In the drawings which form a portion of the original disclosure of the invention.

DETAILED DESCRIPTION OF THE INVENTION

In the following detailed description of the invention, specific preferred embodiments of the invention are described to enable a full and complete understanding of the invention. It will be recognized that it is not intended to limit the invention to the particular preferred embodiments described, and although specific terms are employed in describing the invention, such terms are used in the descriptive sense for the purpose of illustration and not for the purpose of limitation. It will be apparent that the invention is susceptible to variation and changes within the spirit of the teachings herein.

Figures 1, 2:
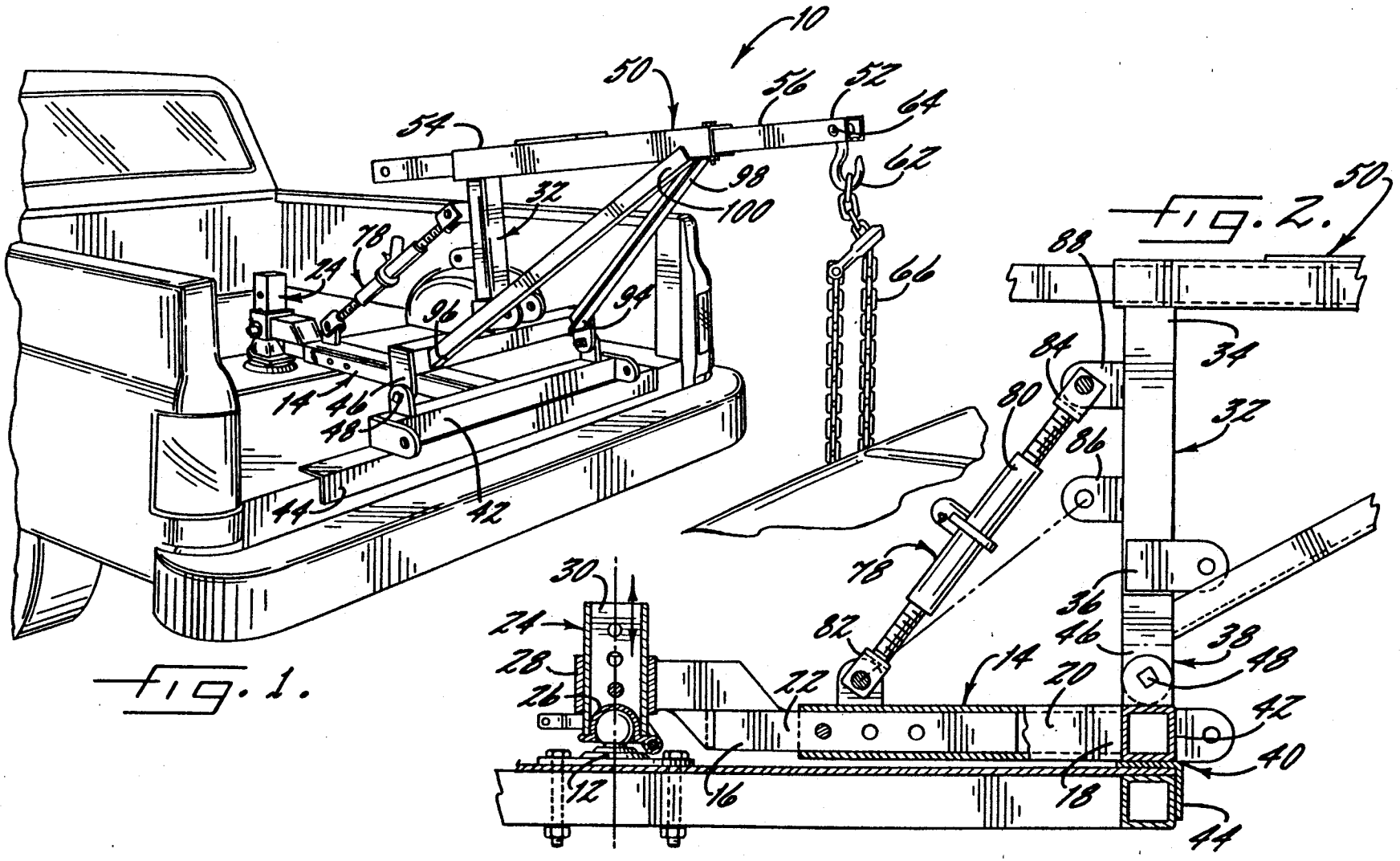
FIG. 1 is a perspective view of one embodiment of a portable hoist of the invention mounted to a ball hitch at a central location in a flat bed of a truck.
FIG. 2 is a sectional side elevation of the hoist of FIG. 1.

Referring now to FIG. 1, a perspective view of a preferred embodiment of a portable hoist according to the invention, designated generally as 10, is illustrated. In FIG. 1, portable hoist 10 is attached to a ball hitch 12 which is centrally located and mounted in the flat bed of a vehicle, illustrated here as a pick-up truck. Such ball-type hitches are well known in the art and may be mounted in the bed of the truck using any of the techniques known to the skilled artisan. For example, ball hitch 12 may be mounted in the flat bed of a truck so that the ball portion thereof rests on the upper surface of the bed of the truck, as illustrated in FIG. 2, a sectional side elevation of the hoist of FIG. 1. The ball hitch may also be secured to the bed of the truck in a recessed portion thereof, as illustrated generally at 12*a* in FIG. 3, so that the ball portion of the hitch does not substantially project above the upper surface of the truck bed.

Portable hoist 10 comprises an elongate base frame member 14 having front and rear opposite ends 16 and 18, respectively. Preferably, elongate frame member 14 is longitudinally adjustable. For example, as illustrated in FIG. 2, elongate frame member 14 may comprise a tubular sleeve 20, and an extension 22 which is telescopically received within sleeve 20 of base frame member 14 such that the longitudinal length of base frame member 14 may be adjusted. Extension 22 may be secured with respect to tubular sleeve 20 in any of the ways known in the art, for example by a linch pin, a threaded shank member, and the like.

A receptacle designated generally as 24 is mounted at the front end 16 of base frame member 14. Receptacle 24 is adapted for releasable attachment to ball hitch 12, such that base frame member 14 may be positioned to extend longitudinally along the bed of the truck with receptacle 24 attached to the ball hitch and with the rear end 18 of base frame member 14 resting upon the rear edge portion of the truck bed. For example, as illustrated in FIG. 2, receptacle 24 may include a substantially spherical socket 26 for receiving the ball portion of ball hitch 12. When spherical socket 26 is engaged with the ball-portion of the ball hitch in the bed of the truck, the socket and hitch form a ball and socket joint of the type known in the art.

Figure 3:
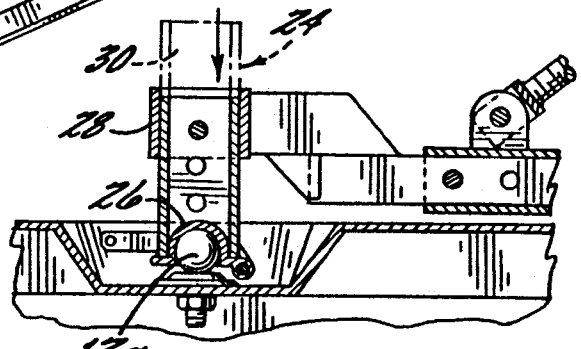
FIG. 3 is a sectional side elevation of one embodiment of a ball hitch for mounting the portable hoist of FIG. 1.

Advantageously, receptacle 24 includes means for mounting the receptacle to front end 16 of base frame member 14 so as to permit selective adjustment of the receptacle along an upright direction with respect to the remainder of base frame member 14, as indicated by the vertical arrow in FIG. 2. This is particularly advantageous when using the portable hoist of the present invention with different vehicles having different ball hitch mountings, including the recessed mounting 12*a* described above. For example, as illustrated in FIGS. 2 and 3, receptacle 24 comprises a tubular sleeve 28 and an extension 30 which is telescopically received within sleeve 28 such that the vertical height of receptacle 24 may be adjusted. As with the extendable portion of the base frame member, extension 28 may also be secured with respect to tubular sleeve 30 in any of the ways known in the art, for example by a linch pin, a threaded shank member, and the like.

Portable hoist 10 further comprises an upright frame member 32. As illustrated in FIG. 2, upright frame member 32 has an upper end 34 and a lower end 36. Portable hoist 10 is provided with means designated generally in FIGS. 1 and 2 at 38 for pivotally interconnecting lower end 36 of upright member 32 to the rear end 18 of the base frame member 14. This permits pivotal movement of upright frame member 32 about a horizontal axis which extends laterally across the bed of the truck.

Preferably means 38 pivotally interconnecting upright member 32 and base frame member 14 include a laterally directed horizontal plate 40. Horizontal plate 40, fixed to the rear end 18 of base frame member 14, is adapted to rest upon the rear end portion of the bed of the truck. For example, as best illustrated in FIG. 1, horizontal plate 40 may be formed using a tubular member 42 attached to an angle or L-shaped piece 44. In addition, means 38 comprises a laterally directed horizontal arm 46 which is fixed to the lower end 36 of upright member 32, with plate 40 and arm 46 being pivotally connected to each other along the horizontal axis, for example by pivotal mounting 48.

Figure 4:
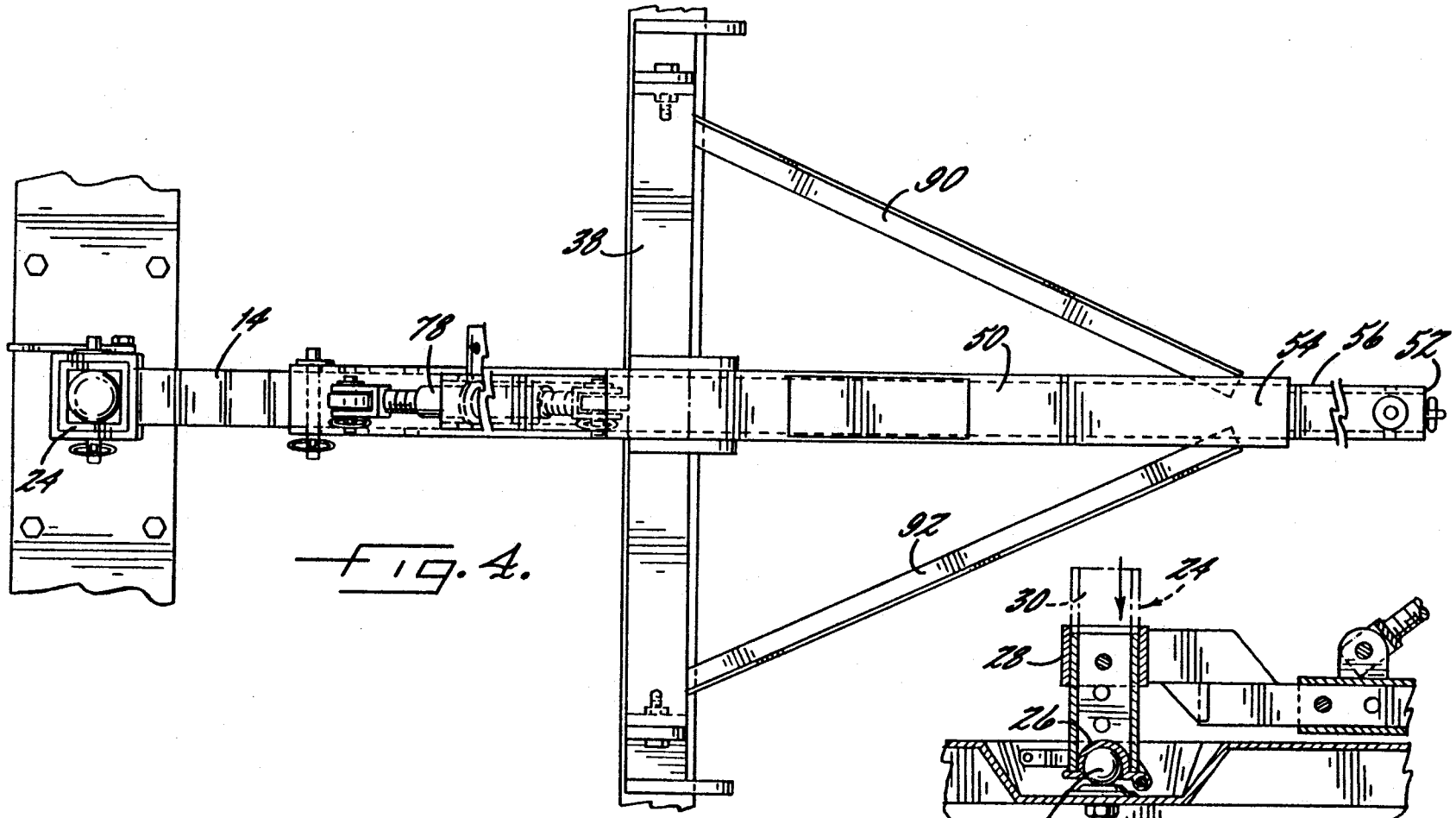
FIG. 4 is a fragmentary plan view of the hoist of FIG. 1.

An elongate boom 50 is provided which is fixedly mounted to upper end 34 of upright member 32 so as to be substantially parallel to and aligned with base frame member 12 when viewed in plan, as best illustrated in FIG. 4. Boom 50 has a free end 52 which is longitudinally beyond rear end 18 of base frame member 12. Preferably boom 50 is extendable, comprising a tubular sleeve 54 and an extension 56 which is telescopically received in sleeve 54 such that the longitudinal length of boom 50 may be adjusted. Extension 56 may also be secured with respect to tubular sleeve 54 in any of the ways known in the art, for example by a linch pin, a threaded shank member, and the like, designated generally as 58 in FIGS. 5 and 6.

Figure 5:
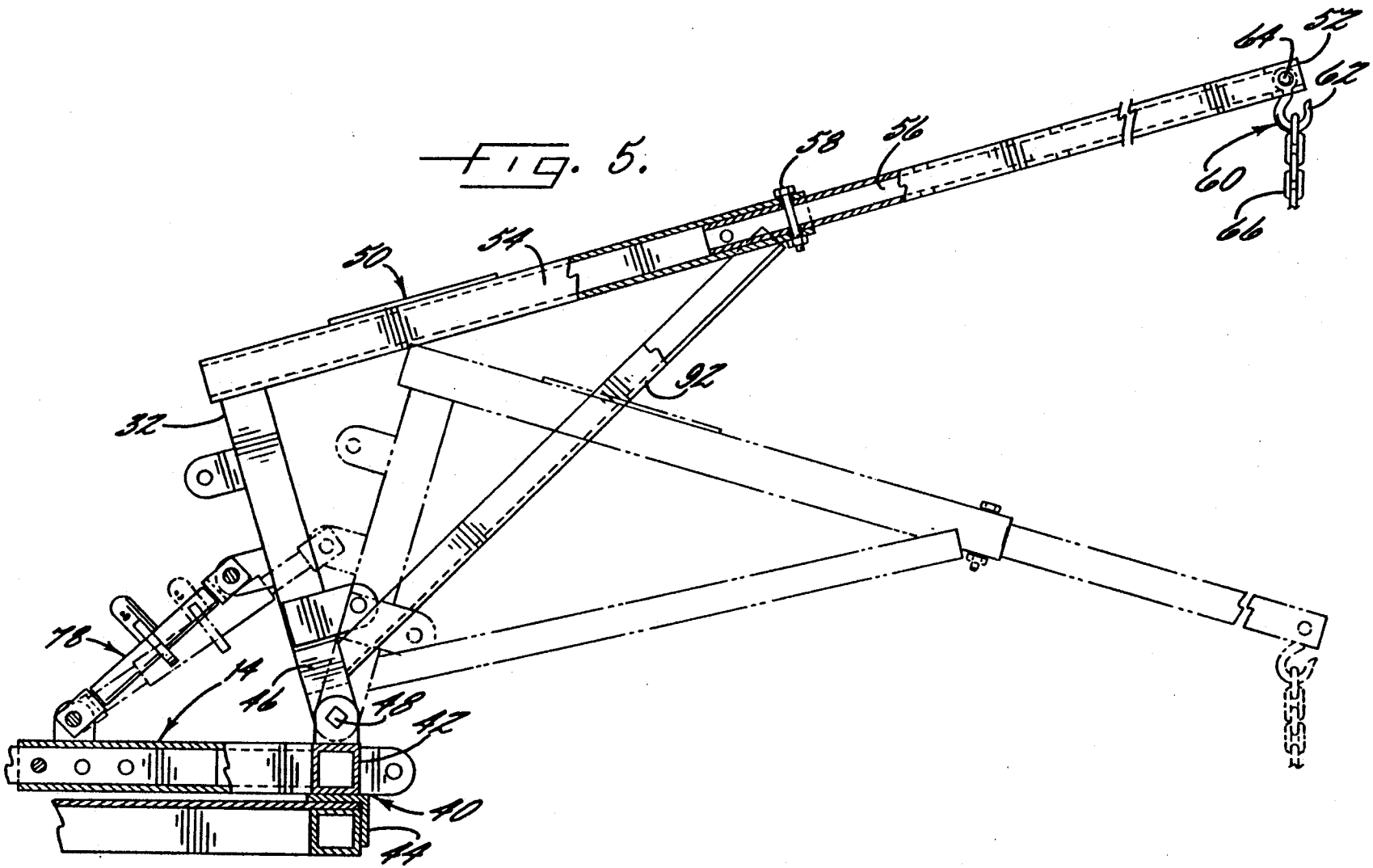
FIG. 5 is a schematic sectional side elevation of the hoist of FIG. 1 in different operative positions and illustrating one embodiment of a load engaging means associated with the portable hoist of the invention.
Figure 6:
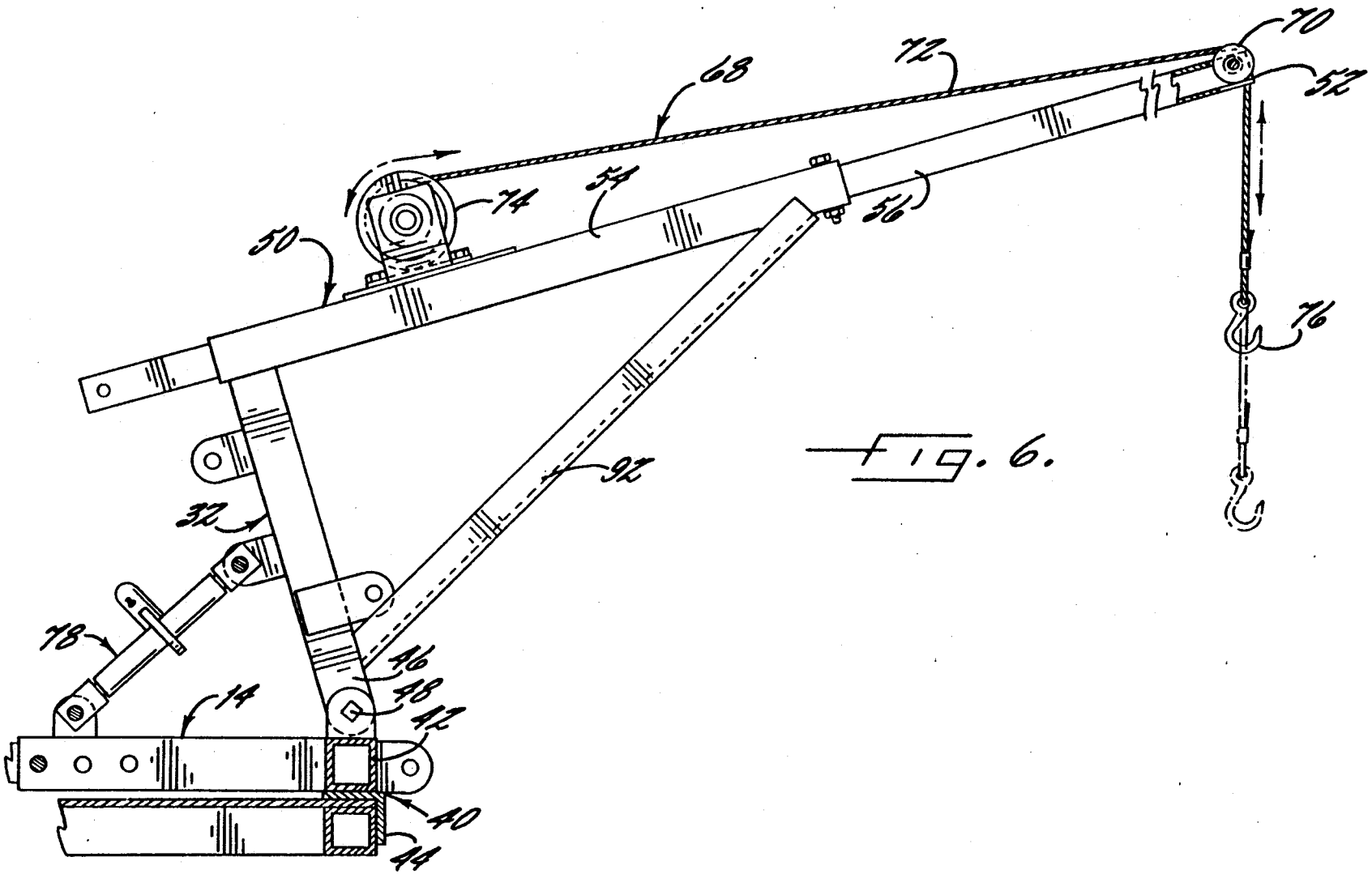
FIG. 6 is a fragmentary side elevation of another embodiment of a load engaging means associated with the portable hoist of the invention.

Boom 50 includes load engaging means mounted at the free end 52 of boom 50, designated generally as 60 in FIGS. 5 and 6. FIGS. 5 and 6 illustrate two preferred embodiments of load engaging means 60 in accordance with the present invention, but as will be appreciated by those skilled in the art, other appropriate load engaging means may also be used.

In FIG. 5, load engaging means 60 is illustrated as a hook 62 attached to the free end 52 of boom 50 by a shank 64. Hook 62 may include a hoist line attached thereto, for example a link chain 66 as illustrated. In FIG. 6, load engaging means 60 is illustrated as a winch designated generally as 68. Winch 68 may be any of the type of devices known in the art for winding a hoist line about a drum or cylinder as a load is raised or lowered, and may be motor-driven or hand-powered. For example, as illustrated in FIG. 6, winch 68 may comprise sheave 70 attached to the free end 52 of boom 50 and having a hoist line 72 looped thereover. A first end of hoist line 72 is wrapped about a rotatable drum 74; hoist line 72 extends substantially longitudinally parallel to and aligned with boom 50 and over sheave 70, so that opposing second end of hoist line 72 falls free. Hoist line 72 may include means for attachment to a load at its free end, illustrated in FIG. 6 as a hook 76.

Movement of portable hoist 10 is achieved via lifting means 78 which is interconnected between base frame member 14 and one of either upright frame member 32 or boom 50. Lifting means 78 is operable to selectively pivot upright frame member 32 and boom 50 about the horizontal axis so as to lift a load which is attached to load engaging means 60.

Lifting means 78 comprises an extendable member 80 having one end 82 connected to base frame member 14 and an opposite end 84 adapted for releasable connection to a selected one of a pair of vertically spaced apart brackets 86 and 88 fixed to upright member 32. Accordingly, end 84 of extendable member 80 may be connected to either of brackets 86 and 88, depending upon the lifting height and range desired, thus permitting adjustment of the lifting movement of the free end 52 of boom 50. In addition, end 84 may be releasably connected to boom 50 so as to provide additional range of movement. Lifting means 78 may be any of the devices known in the art for providing pivotal movement, such as a turnbuckle or screw jack, or a hydraulic cylinder, and may be hand driven, as illustrated, or motor powered.

Advantageously portable hoist 10 of the present invention also includes a pair of upwardly inclined reinforcing braces 90 and 92 which are fixedly mounted between arm 46 and sleeve 52 of boom 50. Braces 90 and 92 are best illustrated in FIG. 1. Braces 90 and 92 have laterally space apart lower ends 94 and 96 fixed to arm 46 and contiguous upper ends 98 and 100 fixed to sleeve 52 of boom 50. Braces 90 and 92 provide additional support for boom 50. Although reinforcing braces 90 and 92 have been illustrated as a pair of braces, it will be appreciated by those skilled in the art that the reinforcing structure may also comprise a single brace fixedly mounted between arm 46 and sleeve 52 so that the brace divides arm 46 into substantially equally sized parts.

The present invention has been described in detail and with particular reference to the preferred embodiments. Those skilled in the art will appreciate that changes can be made without departing from the spirit and scope thereof. Accordingly, the present invention is to be defined by the following claims, with equivalents of the claims to be included therein.

That which is claimed is:

1. A portable hoist adapted for attachment to a ball hitch which is mounted at a central location in a flat bed of a truck, and comprising:

an elongate base frame member comprising front and rear opposite ends;

a receptacle mounted at said front end of said base frame member and which is adapted for releasable attachment to said ball hitch, and such that said base frame member may be positioned to extend longitudinally along the bed of the truck with said receptacle attached to the ball hitch and with said rear end of said base frame member resting upon the rear edge portion of the truck bed;

an upright frame member having an upper end and a lower end;

means pivotally interconnecting said lower end of said upright member to said rear end of said base frame member so as to permit pivotal movement of said upright frame member about a horizontal axis which extends laterally across the bed of the truck;

an elongate boom fixedly mounted to said upper end of said upright member so as to be substantially parallel to and aligned with said base frame member when viewed in plan, with said boom having a free end which is longitudinally beyond said rear end of said base frame member;

load engaging means mounted at said free end of said boom; and lifting means interconnected between said base frame member and one of said upright frame member and said boom and being operable to selectively pivot said upright frame member and said boom about said horizontal axis so as to lift a load which is attached to said load engaging means.

2. The portable hoist as defined in claim 1 wherein said boom comprises a tubular sleeve, and an extension which is telescopically received in said sleeve such that a longitudinal length of said boom may be adjusted.

3. The portable hoist as defined in claim 2 wherein said base frame member comprises a tubular sleeve, and an extension which is telescopically received in said sleeve of said base frame member such that a longitudinal length of said base frame member may be adjusted.

4. The portable hoist as defined in claim 2 wherein said means pivotally interconnecting said upright member and said base frame member includes a laterally directed horizontal plate which is fixed to said rear end of said base frame member and which is adapted to rest upon the rear end portion of the bed of the truck, and a laterally directed horizontal arm which is fixed to said lower end of said upright member, with said plate and said arm being pivotally connected to each other along said horizontal axis.

5. The portable hoist as defined in claim 4 further comprising a pair of upwardly inclined reinforcing braces fixedly mounted between said arm and said sleeve of said boom, with said braces having laterally space apart lower ends fixed to said arm and contiguous upper ends fixed to said sleeve of said boom.

6. The portable hoist as defined in claim 1 further comprising means mounting said receptacle to said front end of said base frame member so as to permit selective adjustment of said receptacle along an upright direction with respect to a remainder of said base frame member.

7. The portable hoist as defined in claim 1 wherein said lifting means comprises an extendable member having one end connected to said base frame member and an opposite end adapted for releasable connection to a selected one of a pair of vertically spaced apart brackets fixed to said upright member, and so as to permit adjustment of the lifting movement of the free end of said boom.

8. The portable hoist as defined in claim 2 wherein said load engaging means is a winch comprising:

a rotatable drum mounted on the sleeve of said boom;

a sheave mounted on the extension of said boom at the free end thereof; and a hoist line attached at one end thereof to and over said drum and extending substantially parallel to and aligned with said boom to and over said sheave so that a second opposing end of said hoist line falls free for attachment to a load.

9. The portable hoist as defined in claim 1 wherein said load engaging means comprises a hook attached at the free end of said elongate boom.

10. A portable hoist adapted for attachment to a ball hitch which is mounted at a central location in a flat bed of a truck, and comprising:

an elongate base frame member comprising front and rear opposite ends, wherein said base frame member comprises a tubular sleeve, and an extension which is telescopically received in said sleeve of said base frame member such that a longitudinal length of said base frame member may be adjusted;

a receptacle mounted at said front end of said base frame member and which is adapted for releasable attachment to said ball hitch, and such that said base frame member may be positioned to extend longitudinally along the bed of the truck with said receptacle attached to the ball hitch and with said rear end of said base frame member resting upon a rear edge portion of the truck bed, and comprising means for mounting said receptacle to said front end of said base frame member so as to permit selective adjustment of said receptacle along an upright direction with respect to a remainder of said base frame member;

an upright frame member having an upper end and a lower end;

means pivotally interconnecting said lower end of said upright member to said rear end of said base frame member so as to permit pivotal movement of said upright frame member about a horizontal axis which extends laterally across the bed of the truck, wherein said means pivotally interconnecting said upright member and said base frame member includes a laterally directed horizontal plate which is fixed to said rear end of said base frame member and which is adapted to rest upon the rear end portion of the bed of the truck, and a laterally directed horizontal arm which is fixed to said lower end of said upright member, with said plate and said arm being pivotally connected to each other along said horizontal axis;

an elongate boom fixedly mounted to said upper end of said upright member so as to be substantially parallel to and aligned with said base frame member when viewed in plan, with said boom having a free end which is longitudinally beyond said rear end of said base frame member, and wherein said boom comprises a tubular sleeve, and an extension which is telescopically received in said sleeve such that a longitudinal length of said boom may be adjusted;

load engaging means mounted at said free end of said boom; and lifting means interconnected between said base frame member and one of said upright frame member and said boom and being operable to selectively pivot said upright frame member and said boom about said horizontal axis so as to lift a load which is attached to said load engaging means.

11. A portable hoist adapted for attachment to a ball hitch which is mounted at a central location in a flat bed of a truck, and comprising:

an elongate base frame member comprising front and rear opposite ends, wherein said base frame member comprises a tubular sleeve, and an extension which is telescopically received in said sleeve of said base frame member such that a longitudinal length of said base frame member may be adjusted;

a receptacle mounted at said front end of said base frame member and which is adapted for releasable attachment to said ball hitch, and such that said base frame member may be positioned to extend longitudinally along the bed of the truck with said receptacle attached to the ball hitch and with said rear end of said base frame member resting upon a rear edge portion of the truck bed, and comprising means for mounting said receptacle to said front end of said base frame member so as to permit selective adjustment of said receptacle along an upright direction with respect to a remainder of said base frame member;

an upright frame member having an upper end and a lower end;

means pivotally interconnecting said lower end of said upright member to said rear end of said base frame member so as to permit pivotal movement of said upright frame member about a horizontal axis which extends laterally across the bed of the truck, wherein said means pivotally interconnecting said upright member and said base frame member includes a laterally directed horizontal plate which is fixed to said rear end of said base frame member and which is adapted to rest upon the rear end portion of the bed of the truck, and a laterally directed horizontal arm which is fixed to said lower end of said upright member, with said plate and said arm being pivotally connected to each other along said horizontal axis;

an elongate boom fixedly mounted to said upper end of said upright member so as to be substantially parallel to and aligned with said base frame member when viewed in plan, with said boom having a free end which is longitudinally beyond said rear end of said base frame member, and wherein said boom comprises a tubular sleeve, and an extension which is telescopically received in said sleeve such that a longitudinal length of said boom may be adjusted;

load engaging means mounted at said free end of said boom;

lifting means interconnected between said base frame member and one of said upright frame member and said boom and being operable to selectively pivot said upright frame member and said boom about said horizontal axis so as to lift a load which is attached to said load engaging means, said lifting means comprising an extendable member having one end connected to said base frame member and an opposite end adapted for releasable connection to a selected one of a pair of vertically spaced apart brackets fixed to said upright member, and so as to permit adjustment of the lifting movement of the free end of said boom; and a pair of upwardly inclined reinforcing braces fixedly mounted between said arm and said sleeve of said boom, with said braces having laterally space apart lower ends fixed to said arm and contiguous upper ends fixed to said sleeve of said boom.

* * * * *